United States Patent [19]

Deming

[11] 3,959,756

[45] May 25, 1976

[54] ELECTRICAL SWITCHING DEVICE

[75] Inventor: Andrew F. Deming, Alliance, Ohio

[73] Assignee: The Alliance Manufacturing Company, Inc., Alliance, Ohio

[22] Filed: Oct. 23, 1974

[21] Appl. No.: 517,046

[52] U.S. Cl. ..... 335/139; 200/61.19; 200/153 M

[51] Int. Cl.[2] ..... H01H 51/08

[58] Field of Search ..... 335/139, 138, 140, 125; 200/61.19, 153 M, 149 R

[56] References Cited

UNITED STATES PATENTS

| | | | |
|---|---|---|---|
| 2,599,953 | 6/1952 | Summers | 200/61.19 |
| 3,106,626 | 10/1963 | Lord et al. | 335/140 |
| 3,239,629 | 3/1966 | Lesser | 200/153 M |
| 3,629,525 | 12/1971 | Giese, Jr. | 335/138 |

*Primary Examiner*—Harold Broome
*Attorney, Agent, or Firm*—Woodling, Krost, Granger & Rust

[57] ABSTRACT

An electrical switching device is disclosed comprising a first and a second support member engageable with one another forming a housing. A plurality of first and second contacts are mounted to the support housing and urged to be in contact with one another. A switching member such as an insulator having a plurality of contact apertures and a plurality of indexing apertures is movably mounted to the support housing and interposed between the first and second contacts. The insulator switching member separates some of the first and second contacts and allows electrical engagement of the others of the contacts through the contact apertures. The invention includes indexing means comprising a solenoid and an indexing member having an indexing arm to engage with an indexing aperture to move the switching member and the contact apertures to cause engagement or disengagement between the plurality of first and second contacts.

21 Claims, 12 Drawing Figures

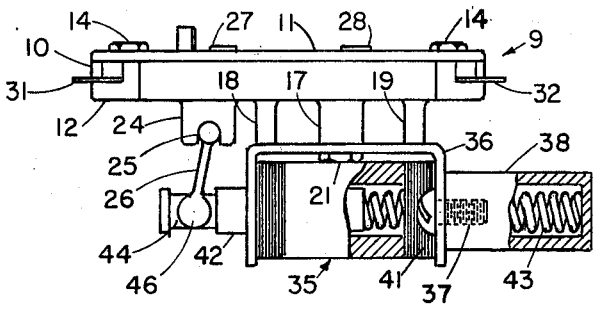
FIG. 1
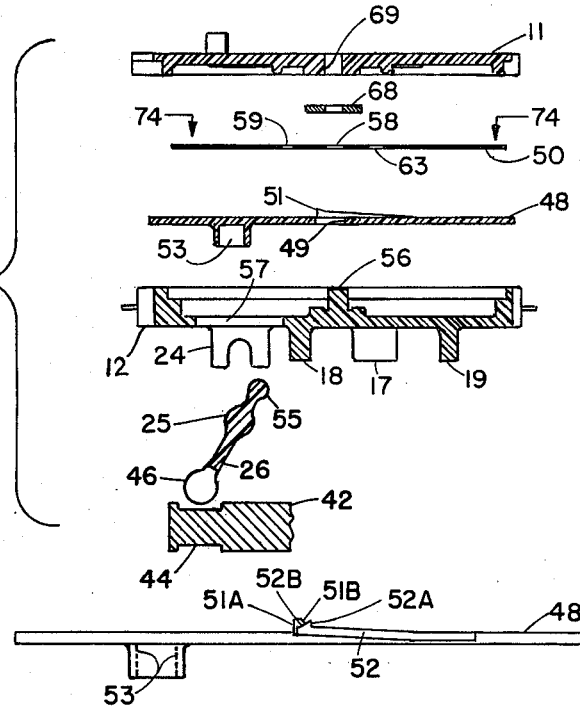
FIG. 2
FIG. 3
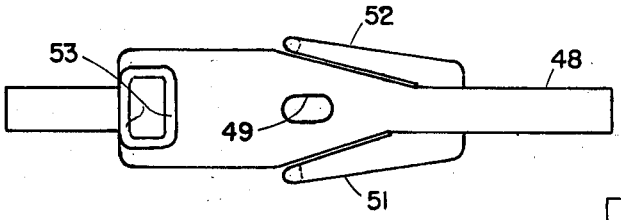
FIG. 4
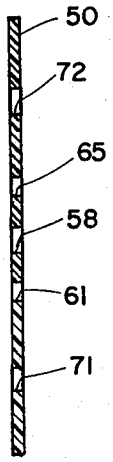
FIG. 6
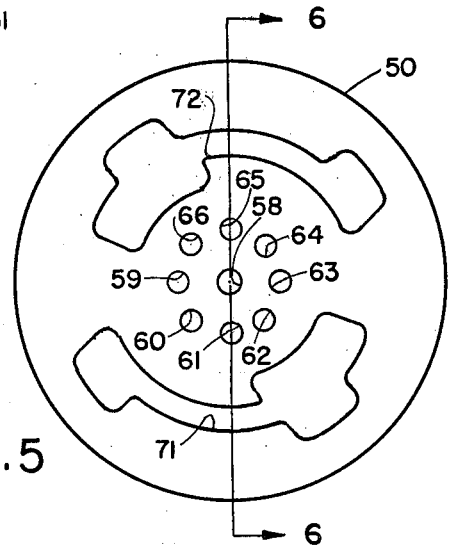
FIG. 5

ELECTRICAL SWITCHING DEVICE

BACKGROUND OF THE INVENTION

1. Field of the Invention

This invention relates to electricity, circuit makers and breakers, special applications with movable or removable interposed non-conductors.

2. Description of the Prior Art

A preferred embodiment of the invention is one incorporating an insulated switching member interposed between conductive contacts. The prior art has known many types of switching devices incorporating an interposed insulating device. Many in the prior art have used solenoids to linearly drive an insulating member between a pair of contacts which were spring mounted to engage one another. Upon energizing the solenoid the insulator is driven between the contact pair thereby separating the contacts and breaking the circuit.

Others in the prior art have incorporated the principle of an interposed insulator for a cut-off switch for a vehicle. An insulator separating a contact pair is attached to the driver of the vehicle by an insulating cord. If the driver is dismounted from the vehicle such as a tractor, the interposed insulator is removed and the contacts short the ignition thereby terminating operation of the vehicle.

Others in the prior art have incorporated the principle of an interposed insulator in a rotary switching device. In these devices, an insulating switching disc having a contact aperture is mounted on a shaft for rotation between contacts on either side of the switching disc. When the contact aperture is rotated between the contacts, the contacts engage through the contact aperture. A further rotation of the switching disc again interposes the insulating disc between the contacts.

In all of the prior art switching devices, the insulating member was fixed to an energizing device such as a solenoid armature or a rotating shaft. In the rotating switching devices, the insulating disc was secured to a rotating shaft to effect rotation of the insulating disc between the contact. Consequently, the location of the contact apertures in the insulating disc was difficult to change. In addition the rotary switches required rotary motion which is not easily obtained by the linear movement of a solenoid. These rotary switches usually exhibit a significant resistance to rotation thereby requiring a powerful solenoid for operation. Finally the construction of such a rotary switch was expensive due to the housing required to journal the shaft and due to the mountings required to secure the insulating disc to the shaft.

Therefore, an object of this invention is to provide an electrical switching device which is easily adaptable to the linear movement of a solenoid.

Another object of this invention is to provide an electrical switching device wherein the electrical switching member may be readily changed.

Another object of this invention is to provide an electrical switching which may be operated by a low power solenoid.

Another object of this invention is to provide an electrical switching device which is reliable and inexpensive.

SUMMARY OF THE INVENTION

The invention may be incorporated in an electrical switching device, comprising in combination, support means, switching means having a contact aperture, one of said means having an indexing aperture, means establishing relative movement between said switching means and said support means, a contact, means mounting said contact relative to said support means for establishing a first contact condition when said contact engages said switching means and for establishing a second contact condition when said contact extends into said contact aperture, one of said first and second conditions being a closed circuit and the other being an open circuit condition, indexing means and means mounting said indexing means for engaging said indexing aperture to relatively move said contact aperture and said contact to switch said contact between said first and second contact conditions.

Other objects and a fuller understanding of the invention may be had by referring to the following description and claims, taken in conjunction with the accompanying drawing.

BRIEF DESCRIPTION OF THE DRAWINGS

FIG. 1 is a side view of an electrical switching device incorporating the present invention;

FIG. 2 is a sectional exploded view of a housing portion taken on line 2—2 of FIG. 8;

FIG. 3 is an enlarged side view of an indexing member of the present invention;

FIG. 4 is an enlarged bottom view of the indexing member in FIG. 3;

FIG. 5 is an enlarged plan view of a switching member;

FIG. 6 is an enlarged sectional view of the switching member taken on line 6—6 of FIG. 5;

DESCRIPTION OF THE PREFERRED EMBODIMENT

Figure 8:
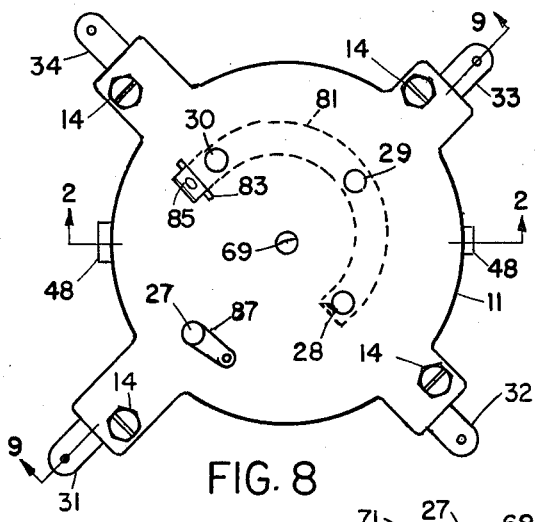
FIG. 8 is a top view of the invention shown in FIG. 2.

FIGS. 1 to 9 illustrate an electrical switching device 9 comprising support means 10 including a first support member 11 and a second support member 12 which are engageable with one another to form a closed housing. The first and second support members 11 and 12 are secured to one another by conventional means shown as self tapping screws 14. A plurality of mounting bosses 17, 18 and 19 are integral with and extend from the second support member 12. Bosses 18 and 19 are solid and extend to the same extent as the hollow boss 17. A hinge 24 extends from the second support member 12 for snap engagement with a pivot 25 of a transfer arm 26. A plurality of first contacts 27, 28, 29 and 30 are secured to the first support member 11 whereas a plurality of second contact arms 31, 32, 33 and 34 are secured between the first and second support members 11 and 12.

Indexing means is provided by a solenoid 35 which includes a mounting bracket 36 engaging the bosses 17, 18 and 19 and is secured to the support means 10 by a threaded screw 21 engaging boss 17. The bracket 36 is mounted by a screw 37 to a rigid frame 38 which forms a part of a larger machine. The bracket 36 holds a solenoid coil 41 acting to pull an armature 42 into the coil 41. A return spring 43 extends into a hole in the frame 38 and urges the armature 42 to the position shown after movement of the armature 42 by the coil 41. The armature 42 has an annular notch 44 for cooperation with a rounded end of a fork 46 of the transfer arm 26 to cause indexing of the electrical switching device 9 upon energizing the solenoid 35.

FIG. 2 is an exploded sectional view of the housing portion of the electrical switcing device 9 shown in FIG. 1. The first support member 11 forms a cover to engage with the second support member 12 which is cup-shaped for receiving an indexing member 48 and a switching means or member 50. The indexing member 48 is slidably mounted to a pivot axle 56 on the second support member 12 by a slot 49 in the indexing member 48. The indexing member 48 has a first indexing arm 51 and a second indexing arm 52 which are shown in FIGS. 3 and 4. A fork 53 cooperates with rounded end 55 of the transfer arm 26 through a hole 57 in the support member 12 to move the indexing member 48 from right to left (in FIG. 2) upon energizing the solenoid 35. The indexing member 48 is returned to the position shown in FIG. 1 by the force exerted by the return spring 43.

The switching member 50 rotates around pivot axle 56 at a central pivot aperture 58 and includes a plurality of indexing apertures 59 through 66, see FIG. 5. The first and second indexing arms 51 and 52 shown in FIGS. 3 and 4 cooperate with the indexing apertures to rotate the switching member 50 upon energizing the solenoid 35.

An unlubricated felt washer 68 is a friction material mounted on the pivot axle 56 and located between the switching disc 50 and the first support member 11 to retard the movement of the switching disc or member 50 to insure proper indexing. An aperture 69 in the first support member 11 receives the pivot axle 56 when the first and second support members 11 and 12 are engaged to secure the indexing member 48, switching disc 50 and felt washer 68 in the closed housing.

FIG. 3 is a side view of the indexing member 48. The first arm 51 includes a pushing surface 51A which is substantially perpendicular to the direction of movement of the indexing member 48 with a ramp surface 51B tapering from the surface 51A to the indexing arm 51. The second arm 52 includes a pulling surface 52A which is substantially perpendicular to the direction of movement of the indexing member 48 with a ramp surface 52B tapering from the surface 52A to the indexing arm 52. The fork 53 is a substantially rectangular cup for receiving the end 55 of the transfer arm 26.

FIG. 4 is an enlarged bottom view of the indexing member 48 showing in greater detail the first and second indexing arms 51 and 52. The slot 49 cooperates with the pivot axle 56 of the second support member 12 allowing the indexing member 48 to slide along a diameter of the member 12. The slot 49 also limits the movement of the indexing member 48.

FIG. 5 is an enlarged plan view of the switching member 50 which is shown as a circular disc having indexing apertures 59–66 uniformly distributed about the pivot aperture 58 on a small radius circle of the switching disc 50. The switching member 50 includes a first and a second contact aperture 71 and 72 near the outer circumference of the switching disc 50. The disc 50 may be disposed between the first and second contact pairs mounted to the support means 10, or the contact pairs may engage each other through a contact aperture. The contact apertures 71 and 72 are by way of example only and numerous variations of contact apertures can be devised under this invention.

FIG. 6 is a side sectional view of the switching disc 50 shown in FIG. 5. The switching disc 50 is formed from a thin sheet of plastic material such as 0.010 Nylatron or a similar material. It may be noted that the indexing and contact apertures are formed by stamping holes in the material and there is no requirement for affixing projections to the switching member to index the switching member.

Figure 7:
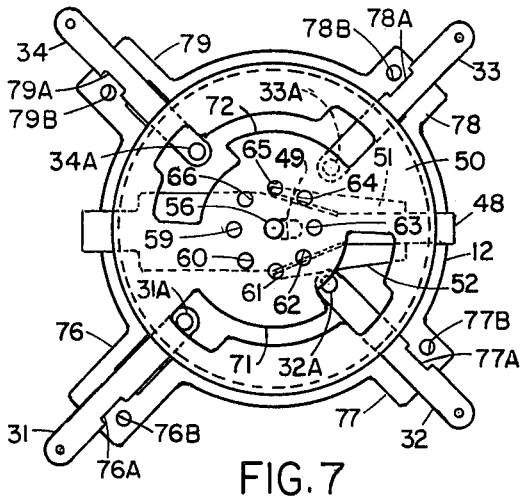
FIG. 7 is a top view of a portion of FIG. 2 as viewed as indicated by the arrows 74.

FIG. 7 is a top view of a portion of the electrical switching device 9 shown in FIG. 2 as would be seen if viewed as indicated by the arrows 74. The second support member 12 includes four contact mountings 76,77, 78 and 79 for respectively holding contact arms 31, 32, 33 and 34. The contact arms 31–34 have second contacts 31A, 32A, 33A and 34A respectively, with the contact arms extending from the contact mountings 76–79 towards the pivot axle 56. Each of the contact mountings 76–79 has a tab 76A, 77A, 78A and 79A, respectively, for positioning the contact arms 31–34 relative to the pivot axle 56 of the support member 12. In addition, each contact mounting has an aperture 76B, 77B, 78B and 79B for receiving a threaded fastener for securing the first support member 11 to the second support member 12.

FIG. 8 is a top view of the electrical switching device 9 shown in FIGS. 1 and 2. The first contacts 27–30 will be in alignment with the second contacts 31A–34A, respectively, when the first support member 11 in FIG. 8 is superimposed on the second support member 12 in FIG. 7. The first contacts 28–30 are connected to a bus bar 81 which extends through a slot 83 in the first support member 11 to provide an electrical connector 85. The first contact 27 is isolated from the first contacts 28–30 having an independent electrical connector 87. The practice of this invention is not limited to the use of bus bar 81 and all of the first contacts 27–30 may be independent of one another.

The contact apertures 71 and 72 in FIG. 7 allow engagement of the first contacts 27, 28 and 30 with the second contacts 31A, 32A and 34A, respectively, while the switching member 50 is interposed between the first contact 29 and the second contact 33A. When electrical current is passed through the solenoid coil 41, the armature 42 is drawn within the solenoid thereby rotating the end 55 of transfer arm 26 and moving the indexing member 48 from right to left in FIG. 7 the distance of the slot 49. The first indexing arm 51 and in particular, the pushing surface 51A, engages and pushes aperture 65 toward the left, thereby rotating the switching member 50 in a counterclockwise direction. The ramp surface 52B of the second arm 52 prohibits engagement of the second arm 52 with the aperture 61 when the indexing member 48 is moved toward the left. When the electrical current is removed from the solenoid coil 41, the pulling surface 52A of the second arm 52 engages aperture 60 which is now positioned to the right of the position shown in FIG. 7 to pull the aperture toward the right and continue the rotation of the switching member 50 in the counterclockwise direction. The ramp surface 51B allows the first arm 51 to disengage aperture 65 when the indexing member 48 is moved toward the right by action of the spring 43. Consequently the ramp surface 52B permits the pushing surface 51A to push aperture 65 without any restriction by the second arm 52 whereas the ramp surface 51B permits the pulling surface 52A to pull aperture 60 without any interference by the first arm 51. The switching member 50 will have rotated approximately 45° so that the indexing apertures 59–65 will be in the position shown in FIG. 7 for the apertures 60–66 respectively. The switching member 50 will be interposed between the first contacts 27, 28 and 29 and the second contacts 31A, 32A, and 33A respectively, while the first contact 30 will engage the second contact 34A through aperture 72. A subsequent energization and deenergization of the solenoid coil 41 will again rotate the switching member 45° such that the indexing apertures 59–66 will be rotated into the positions shown in FIG. 7 to be occupied by the apertures 61–66, 59 and 60, respectively. The first contact 29 will engage the second contact 33A through the first aperture 71 whereas the first contacts 27 and 30 will engage the second contacts 31A and 34A through the second aperture 72. The switching member 50 continues in a counterclockwise rotation in increments of 45° upon subsequent electrical pulses being applied to the solenoid 35 and various contact conditions can exist between the first contacts 27–30 and the corresponding second contacts 31A–34A. The switching arrangement can be modified by changing the number and shape of the contact apertures 71 and 72 and the position of the contacts 27–30 and 31A–34A relative to the pivot axle 56.

Figure 9:
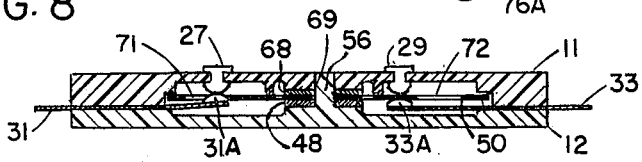
FIG. 9 is a sectional view taken on line 9—9 of FIG. 8.

FIG. 9 is a sectional view of the structure formed by the first support member 11 of FIG. 8 being superimposed upon the second support member 12 of FIG. 7. The first contact 27 and the second contact 31A engage through the contact aperture 71 and the switching member 50 is interposed between the first contact 29 and the second contact 33A. The relationship between the indexing member 48, the switching member 50 and the felt washer 68 are shown relative to the pivot axle 56 and the receiving aperture 69.

Figure 10:
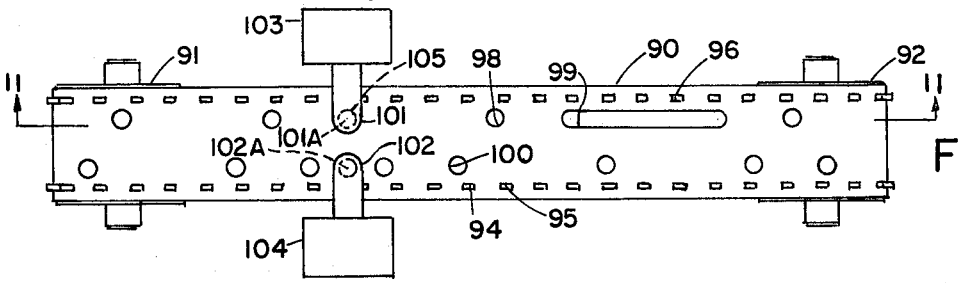
FIG. 10 is a top view showing a variation of the invention in FIGS. 1–9.
Figure 11:
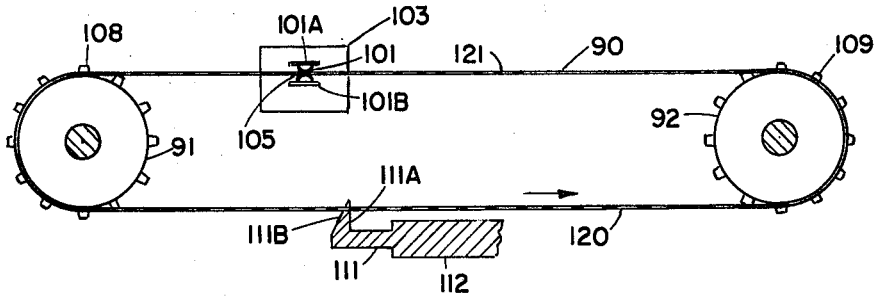
FIG. 11 is a sectional view on line 11—11 of FIG. 10.

FIGS. 10 and 11 show a variation of the invention shown in FIGS. 1–9 incorporating a linearly moving switching means or member 90 shown as an endless belt suspended by a first and second idler drum 91 and 92. The switching member 90 includes a plurality of uniformly spaced rectangular indexing apertures, for example 94, 95 and 96 and a plurality of contact apertures shown as 98, 99 and 100 which are spaced for a switching sequence. A first contact pair 101 is mounted on a contact support 103 with an upper contact 101A being above the switching member 90 and with a lower contact 101B being below the switching member 90 and respectively urged to engage one another. A second contact pair 102 extends from a contact support 104 with the upper contact 102A urged towards the lower contact 102B (not shown) with the switching member 90 interposed therebetween. When a contact aperture, for example 105, is interposed between the contact pair 101 a circuit is completed between the contacts 101A and 101B. Similarly, when a contact aperture such as contact aperture 100 is interposed between the contacts 102A and 102B of contact pair 102 an electrical circuit is completed.

FIG. 11 illustrated a sectional view of FIG. 10 showing the contact pair 101 with the upper contact 101A engaging the lower contact 101B through the aperture 105 in the switching member 90. The idler drums 91 and 92 are more clearly shown having teeth 108 and 109 for cooperation with the indexing apertures to keep the endless switching member 90 on the idler drums 91 and 92. Indexing means is provided, including an indexing member 111 which has a pulling surface 111A and a ramp surface 111B and is connected to an armature 112 similar to armature 42 of solenoid 35. When the armature 112 is moved, the pulling surface 111A engages one of the indexing apertures to pull the switching member 90 in a direction indicated by the arrow. The ramp surface 111B allows the indexing member 111 to disengage the indexing aperture upon right to left movement by a return spring as shown in FIG. 1.

In the embodiment shown in FIGS. 10 and 11 the indexing is accomplished in only one direction of movement of the solenoid armature whereas in FIGS. 1–9 the movement both left to right of the armature was used to index the rotating disc. FIGS. 10 and 11 may be modified by incorporating two indexing arms to index by a first arm in a first direction and to index by a second arm in a second direction in a manner similar to FIGS. 1–9. In such an event, the first arm would engage the lower portion 120 of the switching member 90 during movement of the solenoid armature 112 to the right whereas the second indexing arm would engage the upper portion 121 of the switching member 90 during movement of the solenoid armature 112 to the left.

Figure 12:
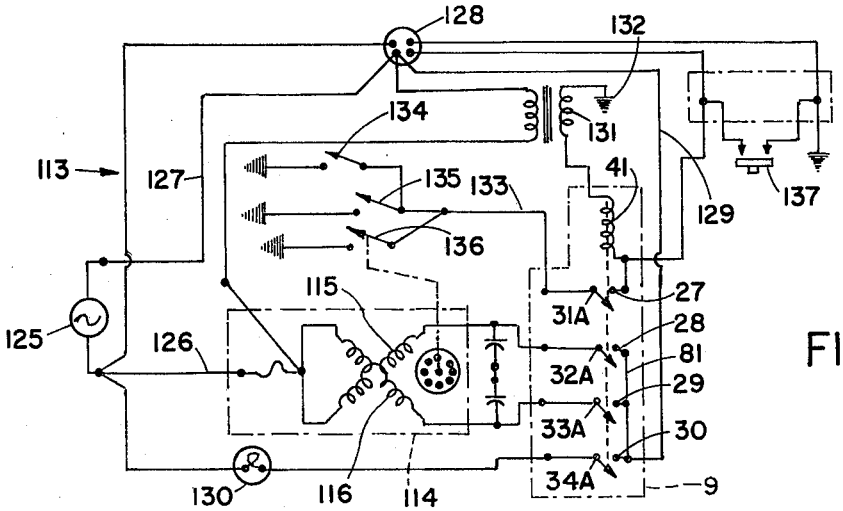
FIG. 12 is an electrical circuit in which the present invention will find application.

FIG. 12 shows a door operator control circuit 113 with which this electrical switching device 9 may be used. The circuit 113 includes a motor 114 having a stator winding 115 energized directly for the upward movement of a garage door and having another stator winding 116 energized directly for the reverse rotation of the motor to cause downward movement of the garage door. The support means 10 including the first contacts 27–30 and the second contacts 31A–34A are illustrated in schematic form in the circuit diagram of FIG. 12. The circuit is energized from a suitable voltage source 125 such as 115 volts Ac 60 Hertz with energization to the motor including a conductor 126 to one end of both stator windings 115 and 116. A conductor 127 leads to a radio connector plug 128 for energization of a radio receiver which may also receive signals to control operation of the control circuit 113. A conductor 129 connects to conductor 127 and supplies source voltage to the stator windings 115 and 116 through the contact pair 28 and 32A and the contact pair 29 and 33A respectively. Contact pair 30 and 34A controls a lamp 130 for illumination of a garage. Contact pair 27 and 31A controls application of low voltage power such as 24 volts from a transformer secondary 131 to the coil 41. One end of the secondary 131 may be grounded at 132 and several switches in parallel. These switches include an up limit switch 134, a down limit switch 135 and a torque switch 136. A push button switch 137 is also connected to ground to energize the coil 41.

The operation of the circuit shown in FIG. 12 is described in U.S. Pat. No. 3,412,350 by Alvin J. Carli which patent is owned by the assignee of the instant invention and is hereby incorporated by reference.

The invention is an electrical switching device comprising support means 10 in FIG. 1 and a switching member shown as 50 and 90 in FIGS. 1 and 10 having contact apertures and indexing apertures. Means are provided for establishing relative movement between the switching members and the support means. The invention includes a contact mounted relative to the support means for establishing a first contact condition when the contact engages the switching member such as contacts 29 and 33A in FIG. 9 and for establishing a second contact condition when the contact extends through the contact aperture such as contacts 27 and 31A in FIG. 9. One of the aforesaid first and second conditions establishes a closed circuit and the other condition establishes an open circuit. The invention includes indexing means mounted relative to the support for engaging an indexing aperture to cause relative movement between the contact aperture and the contact to switch the contact between the first and second contact condition. Although the switching member has been shown as an insulating member interposed between two contacts, it is understood that the invention is equally applicable to a metallic switching member having indexing and contact apertures with a single contact which may be moved between engagement with the metallic switching member and non-engagement when the contact extends through the contact aperture.

The present disclosure includes that contained in the appended claims, as well as that of the foregoing description. Although this invention has been described in its prefered form with a certain degree of particularity, it is understood that the present disclosure of the preferred form has been made only by way of example and that numerous changes in the details of the circuit and the combination and arrangement of circuit elements may be resorted to without departing from the spirit and scope of the invention as hereinafter claimed.

What is claimed:

1. An electrical switching device, comprising in combination:

support means;

switching means having a contact aperture extending through said switching means;

one of said means having an indexing aperture;

means establishing relative movement between said switching means and said support means;

a contact;

means mounting said contact relative to said support means for establishing a first contact condition when said contact engages said switching means and for establishing a second contact condition when said contact extends into said contact aperture, one of said first and second conditions being a closed circuit and the other being an open circuit condition;

indexing means;

and means mounting said indexing means for engaging said indexing aperture to relatively move said contact aperture and said contact to switch said contact between said first and second contact conditions.

2. A device as set forth in claim 1 wherein said indexing means includes an actuator.

3. A device as set forth in claim 1 wherein said indexing means includes a solenoid.

4. A device as set forth in claim 1 where said switching member includes an insulator.

5. A device as set forth in claim 1 wherein said switching member is a disc having an axis of rotation;

said contact aperture being located on one portion of said disc;

and said indexing aperture being located on another portion of said disc.

6. A device as set forth in claim 1 wherein said indexing means includes a first indexing arm;

and said means mounting said indexing means includes said first indexing arm engaging said indexing aperture.

7. A device as set forth in claim 6 wherein said first indexing arm drivingly engages said indexing aperture in only one direction of movement along a line.

8. A device as set forth in claim 1 including means for retarding the relative movement between said switching member and said support means.

9. A device as set forth in claim 1 including a plurality of indexing apertures;

said indexing means including a first and a second indexing arm;

said first indexing arm engaging one of said indexing apertures during movement of said indexing means in a first direction for moving said switching member;

and said second indexing arm engaging another of said indexing apertures during movement of said indexing means in a second direction for moving said switching member.

10. A device as set forth in claim 9 wherein said indexing means includes a solenoid and a return spring, said movement in said first direction includes movement by said solenoid being energized, and said movement in said second direction includes movement by said return spring when said solenoid is deenergized.

11. A device as set forth in claim 9 wherein said first indexing arm pushes against a side of said one of said indexing apertures during movement in one of said first and second direction, and said second indexing arm pulls against a side of said another of said indexing apertures during movement in the other of said first and second direction.

12. An electrical switching device, comprising in combination:

support means;

a pair of contacts;

means mounting said pair of contacts relative to said support means with said pair of contacts urged to engage one another;

a switching member having a contact aperture extending through said switching members and an indexing aperture;

means establishing relative movement between said switching member and said support means with said switching member separating said pair of contacts;

indexing means;

and means establishing cooperation between said indexing means and said indexing aperture for relatively moving said switching member and said pair of contacts upon movement of said indexing means to provide engagement between said pair of contacts through said contact aperture.

13. An electrical switching device, comprising in combination:

support means;

a first and a second pair of contacts;

means for mounting said contact pairs to said support means with said contact pairs respectively urged to be in contact with one another;

a switching member having a contact aperture extending through said switching member and an indexing aperture;

means mounting said switching member for movement relative to said support means with said switching member separating said first pair of contacts and said second pair of contacts engaging one another through said contact aperture;

and indexing means engaging said indexing aperture for moving said switching member to provide engagement between said first pair of contacts through said contact aperture.

14. An electrical switching device, comprising in combination:

a solenoid;

support means having a pivot axis and a plurality of support mountings;

means for mounting said support means to said solenoid;

a plurality of first electrical contacts mounted to said support means;

a plurality of contact arms having second electrical contacts mounted in said plurality of support mountings with said second contacts respectively urged to be in contact with said first contacts;

an indexing member having an indexing arm;

means connecting said indexing member to said solenoid;

a switching disc having a plurality of contact apertures and a plurality of indexing apertures;

means mounting said switching disc for rotation on said pivot axis with said switching disc insulating at least one of said plurality of first and second contacts;

and means for slidably mounting said indexing member to said support means with said indexing arm engaging an indexing aperture to rotate said switching disc upon energizing said solenoid causing engagement between a first and second contact when a contact aperture is rotated therebetween.

15. A device as set forth in claim 14 wherein said support means is substantially circular and said pivot axis extends from substantially the center of said support means.

16. A device as set forth in claim 14 wherein said support means includes a first and a second support member engageable with one another;

and said plurality of first contacts being mounted on said first support member and said plurality of second contacts being mounted on said second support member.

17. A device as set forth in claim 14 wherein said means for slidably mounting said indexing member to said support means includes said support means having a slot for receiving said indexing member.

18. A device as set forth in claim 14 wherein said means connecting said indexing member to said solenoid includes said support means having a hinge mounting;

a transfer arm;

and means for mounting said transfer arm on said hinge mounting and connected between said indexing member and said solenoid.

19. A device as set forth in claim 14 including means for retarding the movement of said switching disc.

20. A device as set forth in claim 14 including a friction material mounted between said support means and said switching disc for retarding the movement of said switching disc to insure proper indexing thereof.

21. A device as set forth in claim 14 wherein said indexing member has a first and a second indexing arm;

said first indexing arm having a pushing surface substantially perpendicular to the direction of movement of said indexing member to push against a side of one of said indexing apertures during movement of said indexing member in a first direction along said slidably mounting means;

said second indexing arm having a pulling surface substantially perpendicular to the direction of movement of said indexing member to pull against a side of one of said indexing apertures during movement of said indexing member in a second direction along said slidably mounting means;

and said first and second indexing arms each having a ramp surface between said pushing and pulling surfaces and said indexing member to prevent engagement of said first and second indexing arms with said apertures during movement in said second and first directions, respectively.

* * * * *